US009637813B2

(12) United States Patent
Thulin et al.

(10) Patent No.: US 9,637,813 B2
(45) Date of Patent: May 2, 2017

(54) DUPLEX STAINLESS STEEL

(71) Applicant: Outokumpu Oyj, Espoo (FI)

(72) Inventors: Alexander Thulin, Lulea (SE); Jan Y. Jonsson, Avesta (SE); Mats Liljas, Avesta (SE); Rachel Pettersson, Norrtalje (SE); Jan-Olof Andersson, Krylbo (SE); Staffan Hertzman, Enskededalen (SE)

(73) Assignee: Outokumpu Oyj, Espoo (FI)

( * ) Notice: Subject to any disclaimer, the term of this patent is extended or adjusted under 35 U.S.C. 154(b) by 329 days.

(21) Appl. No.: 14/355,866

(22) PCT Filed: Nov. 1, 2012

(86) PCT No.: PCT/FI2012/051065
§ 371 (c)(1),
(2) Date: May 2, 2014

(87) PCT Pub. No.: WO2013/064746
PCT Pub. Date: May 10, 2013

(65) Prior Publication Data

US 2015/0050180 A1 Feb. 19, 2015

(30) Foreign Application Priority Data

Nov. 4, 2011 (FI) ..... 20110384

(51) Int. Cl.

| | |
|---|---|
| ***C22C 38/58*** | (2006.01) |
| ***C22C 38/02*** | (2006.01) |
| ***C22C 38/04*** | (2006.01) |
| ***C22C 38/44*** | (2006.01) |
| ***C22C 38/00*** | (2006.01) |
| ***C22C 38/42*** | (2006.01) |
| ***C21D 6/00*** | (2006.01) |

(52) U.S. Cl.
CPC ..... *C22C 38/58* (2013.01); *C21D 6/004* (2013.01); *C22C 38/001* (2013.01); *C22C 38/02* (2013.01); *C22C 38/04* (2013.01); *C22C 38/42* (2013.01); *C22C 38/44* (2013.01); *C21D 2211/005* (2013.01)

(58) Field of Classification Search
CPC ..... C22C 38/58
See application file for complete search history.

(56) References Cited

U.S. PATENT DOCUMENTS

| | | | | |
|---|---|---|---|---|
| 3,567,434 | A | 3/1971 | Richardson et al. | |
| 4,612,069 | A | 9/1986 | Rainger et al. | |
| 5,582,656 | A | 12/1996 | Kangas et al. | |
| 6,174,386 | B1 | 1/2001 | Delblanc-Bauer et al. | |
| 6,312,532 | B1 * | 11/2001 | Kangas | C22C 38/42 148/325 |
| 7,347,903 | B2 | 3/2008 | Yamadera et al. | |

FOREIGN PATENT DOCUMENTS

| | | | | |
|---|---|---|---|---|
| JP | CA 2827103 C | * | 11/2015 | C22C 38/001 |
| WO | 03080886 A1 | | 10/2003 | |

* cited by examiner

*Primary Examiner* — Jessee Roe
*Assistant Examiner* — Christopher Kessler
(74) *Attorney, Agent, or Firm* — The Webb Law Firm

(57) ABSTRACT

The present invention relates to duplex ferritic austenitic stainless steel for the use chemical industry for nitric acid environments wherein good uniform corrosion resistance and high strength are required. The microstructure of the stainless steel has 35-65 volume % of ferrite, preferably 45-55 volume % of ferrite, the balance being austenite. The chemical composition contains less than 0.03 weight % carbon, less than 1 weight % silicon, less than 3 weight % manganese, 26-29.5 weight % chromium, 5-8.5 weight % nickel, 1-3 weight % molybdenum, 0.25-0.35 weight % nitrogen, 1-3 weight % copper, the rest being iron and inevitable impurities occurring in stainless steels.

20 Claims, 6 Drawing Sheets

DUPLEX STAINLESS STEEL

CROSS-REFERENCE TO RELATED APPLICATIONS

This application is the United States national phase of International Application No. PCT/FI2012/051065 filed Nov. 1, 2012, and claims priority to Finland Patent Application No. 20110384 filed Nov. 4, 2011, the disclosures of which are hereby incorporated in their entirety by reference.

BACKGROUND OF THE INVENTION

Field of the Invention

This invention relates to a duplex ferritic austenitic stainless steel, which chemical composition and microstructure are favorable for use in chemical industries wherein good uniform corrosion resistance and high strength are required. One target of use for the steel is in urea manufacturing.

Description of Related Art

It is known that intermetallic precipitates, such as sigma phase, are a troublesome factor in the production and manufacturing of high alloyed duplex ferritic austenitic stainless steel grades. The sigma phase forms in a temperature range of 600-1000° C. and has particular importance, because already a small amount, even less than 1 volume %, of the sigma phase causes a considerable reduction in plasticity, in impact toughness and impairment in corrosion resistance. The fastest kinetics of sigma phase formation occurs at 800-900° C. Once the sigma phase has precipitated, the sigma phase can only be dissolved by annealing above 1050° C. In the presence of large quantities of chromium and molybdenum, the tendency for sigma phase precipitation increases.

The U.S. Pat. No. 5,582,656 relates to a duplex ferritic austenitic stainless steel which contains max 0.05 weight % C, max 0.8 weight % Si, 0.3-4 weight % Mn, 28-35 weight % Cr, 3-10 weight % Ni, 1.0-4.0 weight % Mo, 0.2-0.6 weight % N, max 1.0 weight % Cu, max 2.0 weight % W, max 0.01 weight % S and 0-0.2 weight % Ce, balance being iron. In accordance with the steel of this US patent in the combination with Mo, W, Si and Mn chromium increases the risk of precipitation of intermetallic phases. Further, copper improves the general corrosion resistance in acid environments, such as sulphuric acid, but high contents of copper decrease the pitting and crevice corrosion resistance. The ferrite content in the microstructure is 30-70 volume %, the balance being austenite. The steel is very suitable in the environments that exist in urea production.

The U.S. Pat. No. 7,347,903 describes a duplex stainless steel for urea manufacturing plants. The steel contains less than 0.03 weight % C, less than 0.5 weight % S, less than 2 weight % Mn, 26-28 weight % Cr, 6-10 weight % Ni, 0.2-1.7 weight % Mo, 2-3 weight % W, 0.3-0.4 weight % N, with the balance being iron and impurities, in which the copper content as an impurity is not more than 0.3 weight %. It is also shown in this U.S. Pat. No. 7,347,903, that a greater content of copper accelerates corrosion in the corrosive environment of a urea manufacturing. The sensitivity to sigma phase precipitation during welding is extremely low compared with general duplex stainless steels. The tensile strength is high which allows the use in urea plants.

Both the stainless steels in those above patents, U.S. Pat. No. 5,582,656 and U.S. Pat. No. 7,347,903, have been developed specially for the use in the urea process where the high chromium content and the low molybdenum content as well as the low copper content are a key to have good corrosion rates. Although the duplex stainless steels in the patents, U.S. Pat. No. 5,582,656 and U.S. Pat. No. 7,347,903, are suitable as material in urea manufacturing plants, these stainless steels are difficult to work and to weld.

The U.S. Pat. No. 3,567,434 relates to stainless steels which contain in weight 0.01-0.1° C., 0.2-2.0 Si, 0.2-4.0 Mn, 23-30 Cr, 4-7 Ni, 1-5 Mo, 1-4 Cu, 0.06-0.4 N, the rest being Fe and inevitable impurities in such conditions that the ratio Cr/Ni in weight % shall be at the range of 3.8-6.25 and the ratio (Ni+200×N)/Cr in weight % shall be at the range of 0.74-3.72. The corrosion resistance, especially in sulphuric acid environments, is improved by the addition of molybdenum and copper. Other properties, such as ductility, elongation, are improved and cracking during welding is eliminated by the addition of nitrogen.

The U.S. Pat. No. 4,612,069 describes a pitting resistant duplex stainless steel which contains in weight %<0.08° C., <2.0 Si, <2.0 Mn, 23-29 Cr, 5-9 Ni, <1.0 Mo, 0.5-3.5 Cu, <0.2 N, the rest being Fe and inevitable impurities. According to this patent, the copper addition improves the pitting resistance of the austenite, particularly in acidic chloride-thiosulfate solutions. The stainless steel of this US patent can be furnace cooled from a high temperature to have low levels of residual stress and the sigma and other embrittlement phases are minimized during this slow furnace cooling.

From the U.S. Pat. No. 6,312,532 it is known a duplex ferritic austenitic stainless steel having a good warm workability, high resistance to crevice corrosion and good structural stability and being suitable for applications where high resistance to corrosion is desired, especially in acidic or basic environments with high chloride contents. The steel contains in weight % max 0.05° C., max 0.8 Si, 0.3-4 Mn, 27-35 Cr, 3-10 Ni, 0-3 Mo, 0.30-0.55 N, 0.5-3.0 Cu, 2.0-5.0 W, max 0.01 S the balance being Fe and inevitable impurities. According to this U.S. Pat. No. 6,312,532 the addition of copper has shown to slow down the precipitation of intermetallic phase upon slow cooling, but copper also causes an unfavorable effect on the intergranular corrosion when combined with a high content of molybdenum. Further, the U.S. Pat. No. 6,312,532 claims that in order to ensure good pitting corrosion properties, it shall add high contents of tungsten.

SUMMARY OF THE INVENTION

The object of the present invention is to eliminate some drawbacks of the prior art and to achieve a new duplex ferritic austenitic stainless steel which chemical composition is optimized with the focus on the production and the manufacturing of the duplex stainless steel itself. The introduction of a formula to predict the sensitivity to sigma phase formation significantly helps to select the alloys best suited for industrial production, while the corrosion properties are maintained to be favorable for chemical industry applications, where good uniform corrosion resistance and high strength are required.

According to the invention, the microstructure of the duplex ferritic austenitic stainless steel has 35-65 volume % of ferrite, with a preferred content in the range 45-55 volume % of ferrite, the balance being austenite. The chemical composition of the invention contains less than 0.03 weight % carbon, less than 1 weight % silicon, less than 3 weight % manganese, 26-29.5 weight % chromium, 5-8.5 weight % nickel, 1-3 weight % molybdenum, 0.25-0.35 weight % nitrogen, 1-3 weight % copper and the rest of the chemical composition being iron and inevitable impurities occurring in stainless steels. Sulphur should be limited to less than 0.010 weight % and preferably less than 0.005 weight %. The phosphorus content should be less than 0.040 weight % and the sum of sulphur and phosphorus (S+P) less than 0.04 weight %. The aluminium content should be maximized to less than 0.04 weight % and preferably maximum less than 0.03 weight %, and the total oxygen level below 100 ppm and preferably below 50 ppm.

Optionally less than 1 weight % tungsten and less than 1 weight % of cobalt can be added in the duplex stainless steel of the invention. Further, one or more of the group containing niobium, titanium and vanadium can be optionally added in the duplex stainless steel of the invention, the contents of niobium and titanium being limited up to 0.1 weight % and the vanadium content being limited up to 0.2 weight %. Boron, calcium and/or cerium can also be optionally added in small quantities in duplex stainless steels of the invention. The preferred levels are for boron and calcium, less than 0.003 weight % and for cerium less than 0.1 weight %.

The effects of different elements in the stability and microstructure of the stainless steel according to the invention are described in the following, all the element contents being described in weight %:

Carbon (C) is a representative element for stabilizing austenitic phase and an important element for maintaining mechanical strength. However, if a large content of carbon is used, carbon precipitates carbides and thus reduces corrosion resistance. Therefore, in the present invention the carbon content is limited to less 0.03%.

Silicon (Si) is a ferritic stabilizer which has deoxidation effects in refining. Silicon increases the precipitation speed of intermetallic phases, such as sigma phase, and reduces ductility of the steel. Therefore, in the present invention less than 1%, preferably less than 0.6% silicon is used.

Manganese (Mn) is an austenitic stabilizer which can replace the high-priced nickel. Manganese serves to increase solid solubility of nitrogen and reduces high temperature deformation resistance. A large content of manganese facilitates formation of intermetallic phases. Accordingly, the content of manganese is set up to 3% or less, preferably between 0.5% and 1.5% in the steel of the invention.

Chromium (Cr) is the main addition to make the steel resistant to corrosion. Being ferrite stabilizer chromium is also the main addition to create a proper phase balance between the austenite phase and the ferrite phase. To bring about these functions the chromium level should be at least 26% and to restrict the ferrite phase to appropriate levels for the actual purpose the maximum content should be 29.5%. Preferably the chromium content is 26.5-29%, more preferably 27-28.5%.

Nickel (Ni) is important to stabilize the austenite, improves ductility and improves uniform corrosion resistance. For good ductility and phase stability at least 5%, preferably at least 5.5%, more preferably 5.8% must be added to the steel. Because of nickel's high cost and price fluctuation nickel should be maximized in the present stainless steels to 8.5%, preferably to 7.5%

Molybdenum (Mo) is an important element, like chromium, for maintaining corrosion resistance of the steel, and for this reason molybdenum shall be have a content more than 1%. Molybdenum also stabilizes the ferrite phase and thus influences the phase balance. At the same time molybdenum promotes the formation of intermetallic phases and so molybdenum cannot be added to more than 3%. Preferably, the molybdenum content is 1.5-2.5%.

Copper (Cu) is an austenitic stabilizer for improving corrosion resistance. Especially, when copper is used with molybdenum, copper considerably increases corrosion resistance in acid environments. However, if an appropriate content of copper is not used in consideration of phase ratio with chromium and molybdenum, copper may reduce pitting resistance and facilitate the reduction of the oxidizing agent. Copper also induces substitutional solid solution hardening effects to improve tensile strength and yield strength and decreases the tendency to sigma phase precipitation. According to above copper should be limited above 1% and preferably above 1.3%. High levels of copper can cause problems related to formation of copper precipitation. For this reason the upper limit of copper should be limited to 3% and preferably to 2.5%.

Nitrogen (N) is a strong austenitic stabilizer and is also one of the most important elements for improving corrosion resistance. For the invention the nitrogen content should be limited to 0.25-0.35%. Preferably the nitrogen content should be 0.25-0.33%.

Boron (B), calcium (Ca) and cerium (Ce) can be added in small quantities in duplex steels to improve hot workability and not too high levels as this can deteriorate other properties. The preferred levels are for boron and calcium, less than 0.003% and for cerium less than 0.1%.

Sulphur (S) in duplex steels deteriorates hot workability and can form sulphide inclusions that influence pitting corrosion resistance negatively. The content of sulphur should therefore be limited to less than 0.010% and preferably less than 0.005%.

Phosphorus (P) deteriorates hot workability and can form phosphide particles or films that influence corrosion resistance negatively. The content of phosphorus should therefore be limited to less than 0.040%, and so that the sum of sulphur and phosphorus (S+P) contents is less than 0.04%.

Oxygen (O) together with other residual elements has an adverse effect on hot ductility. For this reason it is important to control its presence to low levels, particularly for highly alloyed duplex grades that are susceptible to cracking. Presence of oxide inclusions may reduce corrosion resistance (pitting corrosion) depending on the type of inclusion. A high oxygen content also reduces impact toughness. In a similar manner as sulfur oxygen improves weld penetration by changing the surface energy of the weld pool. For the present invention the advisable maximum oxygen level is below 100 ppm and preferably below 50 ppm. In a case of a metallic powder the maximum oxygen content can be up to 250 ppm.

Aluminium (Al) should be kept at a low level in the duplex stainless steel of the invention. With high nitrogen content these two elements can combine and form aluminium nitrides that will deteriorate impact toughness. Aluminium should be limited to less than 0.04%, preferably less than 0.03%.

Tungsten (W) has similar properties as molybdenum and can sometimes replace molybdenum. However, tungsten can promote sigma phase precipitation and should be limited to maximum 1%.

Cobalt (Co) has similar metallurgical behaviour as its sister element, nickel, and it may be treated in much the same way in steel and alloy production, it inhibits grain growth at elevated temperatures and considerably improves the retention of hardness and hot strength. Cobalt reduces the risk of sigma phase formation in super duplex stainless steels but is less cost effective than nickel and should be maximised to 1%.

The "micro-alloying" elements titanium (Ti), vanadium (V) and niobium (Nb) belong to a group of additions so named because they significantly change the steels properties at low concentrations, often beneficial effects in carbon steel but in the case of duplex stainless steels they also contribute to undesired property changes, such as reduced impact properties, higher surface defects levels and reduced ductility during casting and hot rolling and removal of nitrogen from solid solution. Many of these effects depend on their strong affinity for carbon and nitrogen, in particular nitrogen in the case of modern duplex stainless steels. In the present invention niobium and titanium should be limited to maximum level of 0.1% whereas vanadium is less detrimental and should be less than 0.2%.

BRIEF DESCRIPTION OF THE DRAWINGS

The present invention is described in more details in the following referring to the drawings where.

DESCRIPTION OF THE INVENTION

Figure 1:
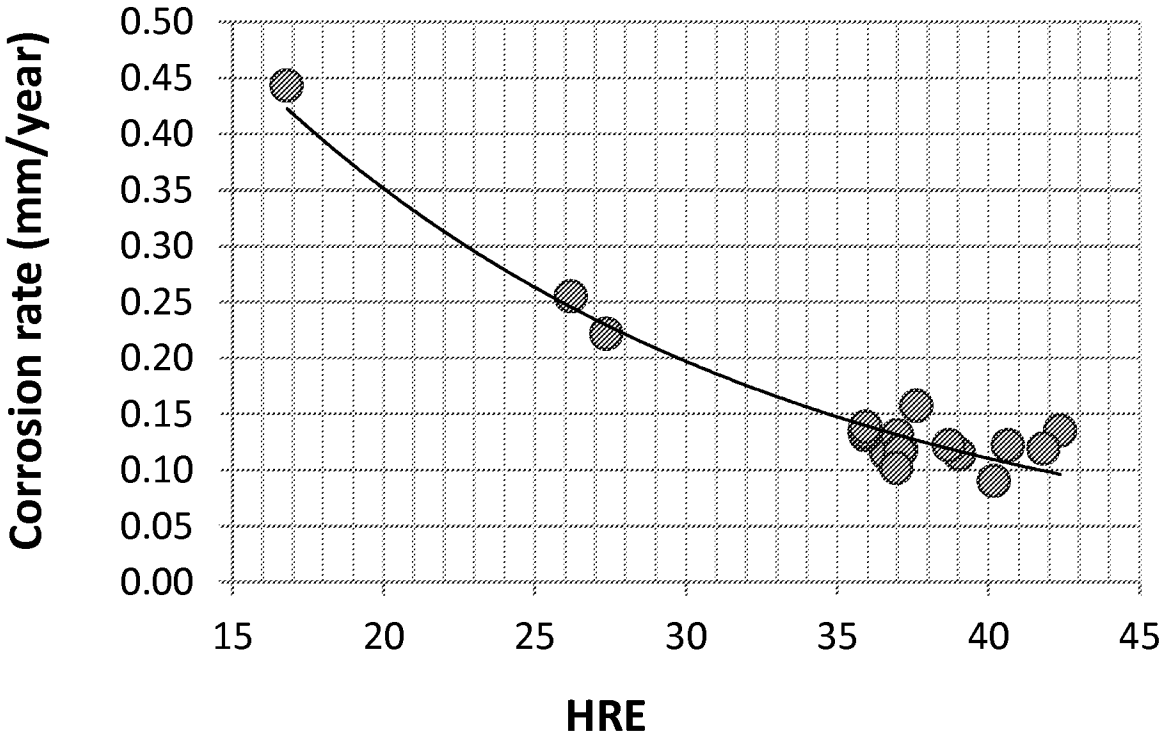
FIG. 1 illustrates the weight loss in Huey test for different stainless steels as a function of Huey resistant equivalent (HRE)

The chemical compositions for the duplex stainless steels of the invention used in the following tests are given in the Table 1. The Table 1 also contains the chemical compositions for the known duplex stainless steels LDX 2101®, LDX 2404®, 2304, 2205 and 2507 (alloys 22-26) used in the tests as the reference materials.

TABLE 1

| Steel | C % | Si % | Mn % | Cr % | Ni % | Mo % | Cu % | N % |
|---|---|---|---|---|---|---|---|---|
| 1 | 0.02 | 0.6 | 0.5 | 27.8 | 9.4 | 1.9 | 1.0 | 0.18 |
| 2 | 0.04 | 0.3 | 5.0 | 31.2 | 7.5 | 1.7 | 0.2 | 0.38 |
| 3 | 0.02 | 0.4 | 1.0 | 28.6 | 7.0 | 2.2 | 0.2 | 0.30 |
| 4 | 0.02 | 0.3 | 0.6 | 27.6 | 7.5 | 1.1 | 0.1 | 0.29 |
| 5 | 0.02 | 0.2 | 3.8 | 30.0 | 9.5 | 2.1 | 0.2 | 0.30 |
| 6 | 0.02 | 0.5 | 0.8 | 27.8 | 9.3 | 1.9 | 1.0 | 0.17 |
| 7 | 0.01 | 0.6 | 0.8 | 28.2 | 8.0 | 2.4 | 1.0 | 0.22 |
| 8 | 0.02 | 0.7 | 0.4 | 27.6 | 10.3 | 1.8 | 1.0 | 0.12 |
| 9 | 0.02 | 0.6 | 0.5 | 27.9 | 10.0 | 1.8 | 1.0 | 0.14 |
| 10 | 0.02 | 0.6 | 0.5 | 28.2 | 9.8 | 1.9 | 0.9 | 0.16 |
| 11 | 0.02 | 1.0 | 0.5 | 28.0 | 7.3 | 0.3 | 0.2 | 0.24 |
| 12 | 0.02 | 0.2 | 0.9 | 24.9 | 7.0 | 4.0 | 0.3 | 0.25 |
| 13 | 0.02 | 0.6 | 7.5 | 26.2 | 3.7 | 1.6 | 1.0 | 0.33 |
| 14 | 0.02 | 0.2 | 1.0 | 29.9 | 7.5 | 2.3 | 0.1 | 0.33 |
| 15 | 0.04 | 0.2 | 6.2 | 30.4 | 5.6 | 1.5 | 0.2 | 0.37 |
| 16 | 0.02 | 0.3 | 1.4 | 30.2 | 5.9 | 1.5 | 0.2 | 0.38 |
| 17 | 0.02 | 0.3 | 7.8 | 30.4 | 5.7 | 1.6 | 0.3 | 0.43 |
| 18 | 0.02 | 0.3 | 5.0 | 29.9 | 6.6 | 1.5 | 0.2 | 0.38 |
| 19 | 0.02 | 0.3 | 4.8 | 29.9 | 5.8 | 1.5 | 1.5 | 0.41 |
| 20 | 0.02 | 0.3 | 5.0 | 30.1 | 5.2 | 1.5 | 0.2 | 0.46 |
| 21 | 0.03 | 1.0 | 0.4 | 26.8 | 7.1 | 0.8 | 1.7 | 0.29 |
| 22 (LDX 2101) | 0.03 | 0.7 | 5.0 | 21.3 | 1.6 | 0.2 | 0.3 | 0.21 |
| 23 (2304) | 0.02 | 0.4 | 1.3 | 22.8 | 4.2 | 0.2 | 0.3 | 0.13 |

TABLE 1-continued

| Steel | C % | Si % | Mn % | Cr % | Ni % | Mo % | Cu % | N % |
|---|---|---|---|---|---|---|---|---|
| 24 (LDX 2404) | 0.03 | 0.4 | 3.0 | 23.9 | 3.7 | 1.6 | 0.4 | 0.28 |
| 25 (2507) | 0.01 | 0.4 | 0.8 | 25.0 | 6.9 | 3.8 | 0.2 | 0.29 |
| 26 (2205) | 0.02 | 0.3 | 1.4 | 22.4 | 5.7 | 3.2 | 0.2 | 0.18 |
| 27 | 0.01 | 0.3 | 1.1 | 26.9 | 6.3 | 1.8 | 1.4 | 0.33 |
| 28 | 0.02 | 0.3 | 1.0 | 27.3 | 6.6 | 1.9 | 1.6 | 0.36 |
| 29 | 0.03 | 0.2 | 2.3 | 27.9 | 6.7 | 1.9 | 1.7 | 0.30 |
| 30 | 0.02 | 0.7 | 1.1 | 28.2 | 6.2 | 1.9 | 1.5 | 0.29 |
| 31 | 0.02 | 0.7 | 0.6 | 26.8 | 6.5 | 1.9 | 1.8 | 0.33 |
| 32 | 0.02 | 0.3 | 1.2 | 27.2 | 6.2 | 1.8 | 1.4 | 0.28 |
| 33 | 0.02 | 0.3 | 1.1 | 28.2 | 6.6 | 1.8 | 1.3 | 0.28 |
| 34 | 0.02 | 0.3 | 1.0 | 27.3 | 6.7 | 1.8 | 1.7 | 0.28 |

The duplex ferritic austenitic stainless steels according to the invention were tested by the Huey test for the corrosion resistance in nitric acid. This also provides an assessment of the susceptibility for intergranular corrosion and an indicative measure of the performance of the steel in urea production at elevated temperatures and pressures. In the Huey test (ASTM A262, practice C) the corrosion testing of the steel is made in a boiling solution of nitric acid so that the samples are boiled for 5 consecutive periods of 48 hours each in 65% nitric acid, each period starting with fresh acid. The corrosion rate is calculated for each period from weight losses. The weight of metal lost is converted into loss in mm/year (millimeter per year). In the following Table 2 the corrosion rates of the stainless steels of the invention are compared with reference duplex stainless steels LDX 2101, LDX 2404 and 2304. The Table 2 also contains the HRE (Huey Equivalent) value in weight %, where the contributing effect of each alloying element is taken into account, and which HRE value is calculated from the formula (1), the values of each element being in weight %:

$$HRE=Cr+1.5\times Ni-1.4\times Mn+0.6\times Mo+0.1\times N. \quad (1)$$

The formula for the HRE value indicates that chromium and more so nickel have a large positive influence on the Huey test, while manganese is negative in this respect. Molybdenum and nitrogen are shown to have less effect. The effect of copper is so small as to be excluded from the equation.

The pitting resistance equivalent (PRE) for the duplex stainless steels of the Table 1 is calculated using the formula (2), the values of each element being in weight %:

$$PRE=Cr+3.3\times Mo+30\times N—Mn \quad (2)$$

TABLE 2

| Steel | Corrosion rate mm/y | HRE | PRE |
|---|---|---|---|
| 1 | 0.135 | 42 | 39 |
| 2 | 0.115 | 37 | 43 |
| 3 | 0.114 | 39 | 44 |
| 4 | 0.122 | 39 | 39 |
| 5 | 0.090 | 40 | 42 |
| 6 | 0.119 | 42 | 39 |
| 7 | 0.122 | 41 | 42 |
| 22 (LDX 2101) | 0.443 | 17 | 23 |
| 23 (2304) | 0.222 | 27 | 26 |
| 24 (LDX 2404) | 0.255 | 26 | 34 |
| 27 | 0.134 | 36 | 42 |
| 28 | 0.102 | 37 | 43 |
| 29 | 0.131 | 36 | 41 |
| 30 | 0.118 | 37 | 42 |
| 31 | 0.131 | 37 | 42 |

TABLE 2-continued

| Steel | Corrosion rate mm/y | HRE | PRE |
|---|---|---|---|
| 32 | 0.138 | 36 | 40 |
| 33 | 0.157 | 38 | 41 |
| 34 | 0.116 | 37 | 41 |

The corrosion rates presented in the Table 2 are illustrated in FIG. 1 as a function of the HRE value. The results presented in FIG. 1 show the combined effect of the alloying elements as described above in the HRE and further show that the greater the Huey equivalent is, the smaller the corrosion rate. For the desired corrosion rate of the invention the HRE value is advantageously limited to a minimum values of 35 which in the Huey test corresponds to a corrosion rate of 0.14 mm/year.

According to the results in the Table 2 the pitting resistance equivalent value (PRE) in the duplex stainless steel of the invention is at the range of more than 41.

The resistance of the steel to corrosion in sulphuric acid is of major importance in governing applications for manufacturing and transportation of chemicals, tests were conducted in 10% sulphuric acid using three successive test periods of 24 hours, 72 hours and 72 hours at constant temperature. At the start of the third period the specimen was activated by contact with zinc to depassivate the specimen and ensure a more demanding test. Based on the results of tests at 65° C., 95° C. and the boiling temperature (BT), (104° C.), the sulphuric acid resistance equivalent (SRE) is evaluated as the formula (3), wherein T is the testing temperature in ° C. and the values of each element are in weight %:

$$SRE=Cr+0.4\times Ni-1.1\times Mn+0.75\times Mo+2.2\times Cu+24\times N-0.3\times T \quad (3)$$

Figure 2:
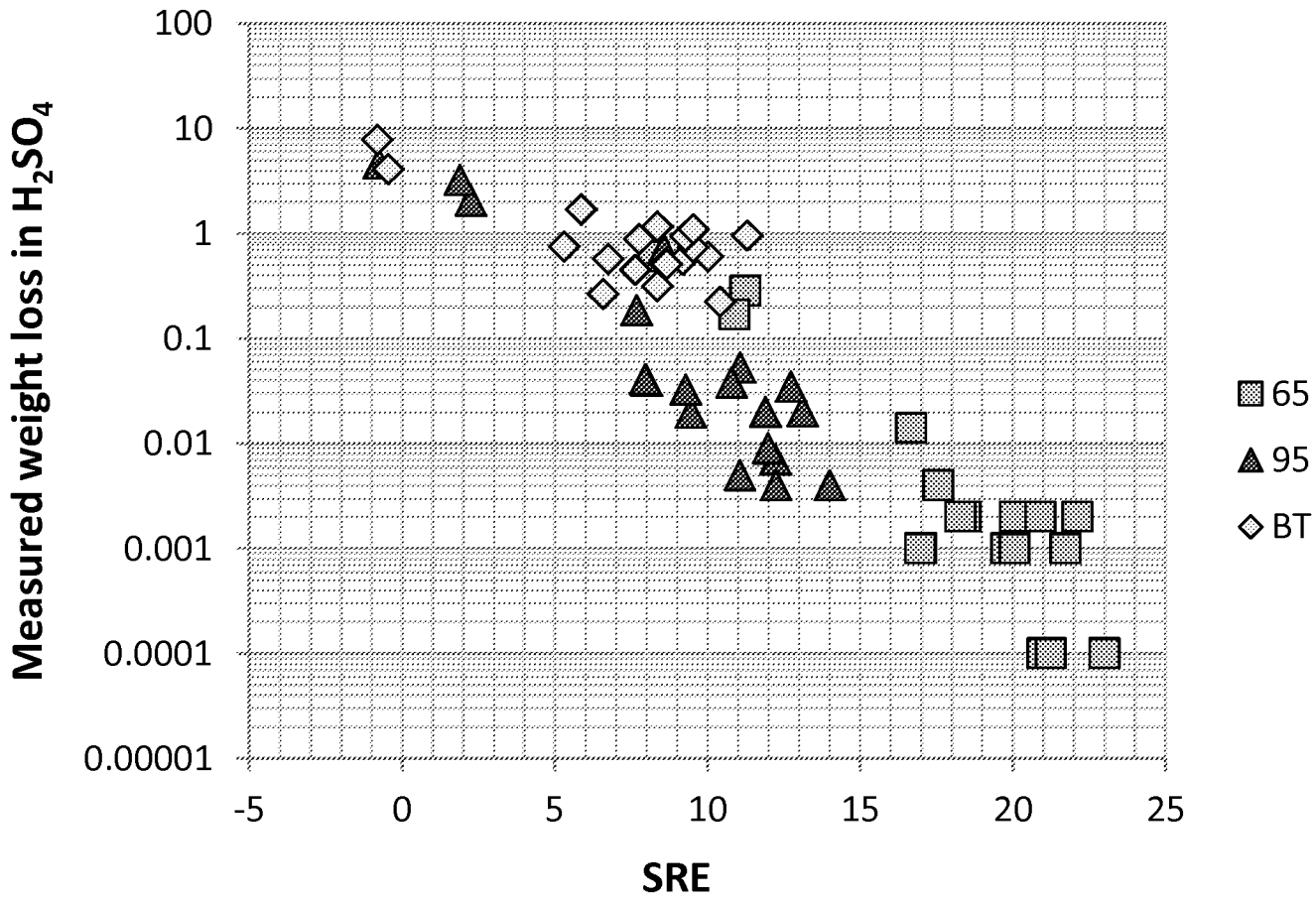
FIG. 2 illustrates the weight loss in 10% sulphuric acid Huey test temperatures 65° C., 95° C. and boiling temperature (BT), about 104° C., as a function of Sulphuric acid Resistant Equivalent (SRE)

The results of the sulphuric acid test and the calculated values for the tested alloys are enlisted in Table 3. It can for instance be seen that for a SRE more than 8 (for T=104° C.) a sulphuric acid resistance well above alloys similar to 2507 (alloy 25) is achieved. The weight loss presented in Table 3 is also illustrated in FIG. 2 where it can be seen that the higher the SRE is the smaller the weight loss in sulphuric acid is. In the FIG. 2 there is also an example of an examined alloy inside the suggested invention for different tested temperatures.

TABLE 3

| steel | H2SO4 (65° C.) mm/y | SRE | H2SO4 (95° C.) mm/y | SRE | H2SO4 (104° C.) mm/y | SRE |
|---|---|---|---|---|---|---|
| 1 | | 19 | | 10 | 0.9 | 8 |
| 2 | | 20 | | 11 | 0.5 | 9 |
| 3 | 0.002 | 20 | 0.05 | 11 | 0.3 | 8 |
| 4 | 0.002 | 18 | 0.02 | 9 | 0.6 | 7 |
| 5 | | 19 | | 10 | 0.4 | 8 |
| 7 | | 20 | | 11 | 0.5 | 9 |
| 12 | 0.001 | 17 | 0.04 | 8 | 0.8 | 5 |
| 15 | 0.001 | 17 | 0.04 | 8 | | 5 |
| 16 | 0.002 | 22 | 0.02 | 13 | 0.2 | 10 |
| 17 | 0.014 | 17 | 0.19 | 8 | | 5 |
| 18 | 0.002 | 18 | 0.03 | 9 | 0.3 | 7 |
| 19 | 0.001 | 22 | 0.03 | 13 | 0.6 | 10 |
| 20 | 0.001 | 20 | 0.04 | 11 | | 8 |
| 23 | 0.600 | 8 | 4.63 | −1 | | −3 |
| 24 | 0.284 | 11 | 2.06 | 2 | 4.1 | 0 |
| 25 | 0.004 | 18 | 0.70 | 9 | 1.7 | 6 |
| 26 | 0.168 | 11 | 3.22 | 2 | 7.8 | −1 |
| 27 | 0.000 | 21 | 0.01 | 12 | 0.7 | 10 |

TABLE 3-continued

| steel | H2SO4 (65° C.) mm/y | SRE | H2SO4 (95° C.) mm/y | SRE | H2SO4 (104° C.) mm/y | SRE |
|---|---|---|---|---|---|---|
| 28 | 0.000 | 23 | 0.00 | 14 | 0.9 | 11 |
| 29 | 0.002 | 21 | 0.02 | 12 | 0.6 | 9 |
| 32 | 0.001 | 20 | 0.01 | 11 | 1.2 | 8 |
| 33 | 0.000 | 21 | 0.01 | 12 | 0.9 | 9 |
| 34 | 0.000 | 21 | 0.00 | 12 | 1.1 | 10 |

According to the results in the Table 3 the sulphuric acid corrosion resistance SRE according to the formula (3) for the duplex stainless steel of the invention is above 8 at the boiling temperature (BT, 104° C.) of sulphuric acid, above 11 at the temperature 95° C. and above 20 at the temperature 65° C.

The structural stability for the duplex ferritic austenitic stainless steel of the invention was tested by determining the sigma phase content. All the tested alloys were heat treated at the temperature of 850° C. for 10 min because of fastest kinetics in sigma phase formation at this temperature. After the heat treatment and cooling of the alloy the sigma phase content was metallographically determined.

The resistance of the alloys to sigma phase precipitation is described by the sigma equivalent (SGR) in the formula (4) the values of each element being in weight %:

$$SGR=Cr+2\times Mo-40\times N+0.5\times Mn-2\times Cu \quad (4)$$

The sigma equivalent shows a general formula for the structural stability for high alloyed duplex ferritic austenitic stainless steels. The smaller the sigma equivalent, the more stable the alloy. For the desired stability against sigma phase precipitation of the invention the SGR value is advantageously limited to less than 18.

Figure 3:
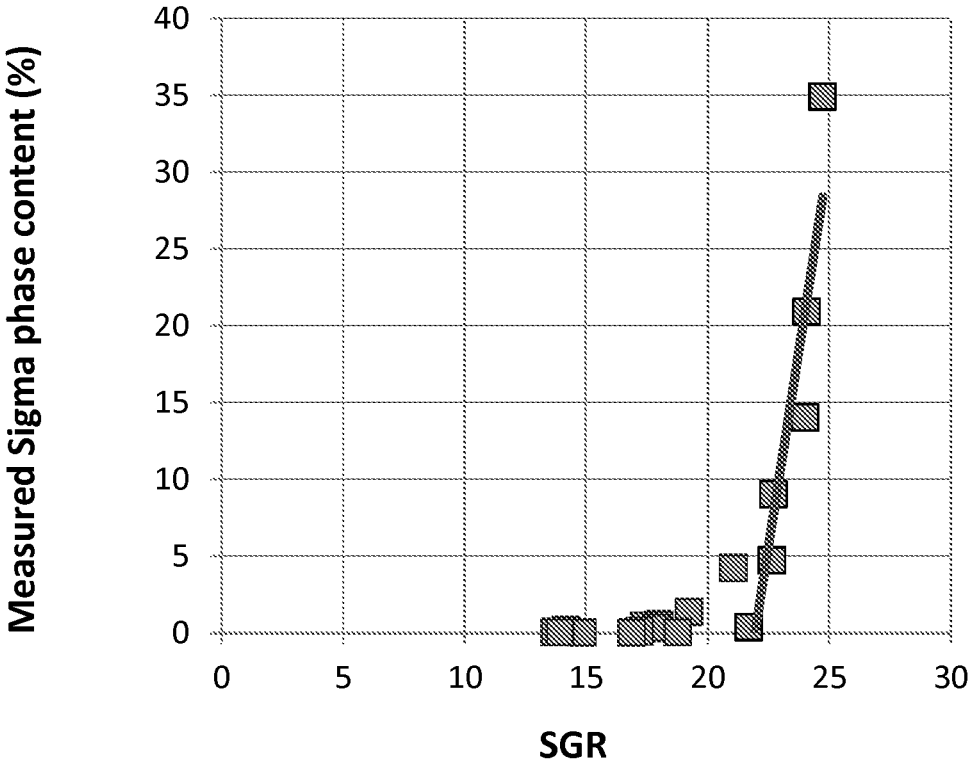
FIG. 3 illustrates the sigma phase content in different stainless steels as a function of sigma phase equivalent (SGR)

The results concerning the sigma phase content and the sigma equivalent (SGR) in the tested alloys are presented in the Table 4 and are illustrated in the FIG. 3 showing the measured sigma phase content as a function of the sigma equivalent (SGR). The selected alloys of the invention show a significantly lower tendency of SGR values for sigma phase formation than the alloy 25 (2507) which is well known for production difficulties and for sigma phase brittle behavior in processing lines.

TABLE 4

| Steel | Sigma phase content % | SGR % |
|---|---|---|
| 1 | 9.0 | 23 |
| 8 | 34.9 | 25 |
| 9 | 20.9 | 24 |
| 10 | 14.0 | 24 |
| 11 | 1.4 | 19 |
| 12 | 4.7 | 23 |
| 13 | 0.5 | 18 |
| 14 | 0.4 | 22 |
| 21 | 0.05 | 14 |
| 25 | 4.2 | 21 |
| 27 | 0 | 15 |
| 28 | 0.05 | 14 |
| 29 | 0.4 | 17 |
| 30 | 0.3 | 18 |
| 31 | 0.2 | 14 |
| 32 | 0.1 | 17 |
| 33 | 0.05 | 19 |
| 34 | 0 | 17 |

The results of the analysis show that nitrogen has a great effect to decrease the formation of the sigma phase. Surprisingly, also copper shows a tendency to decrease the formation of the sigma phase.

Figure 4:
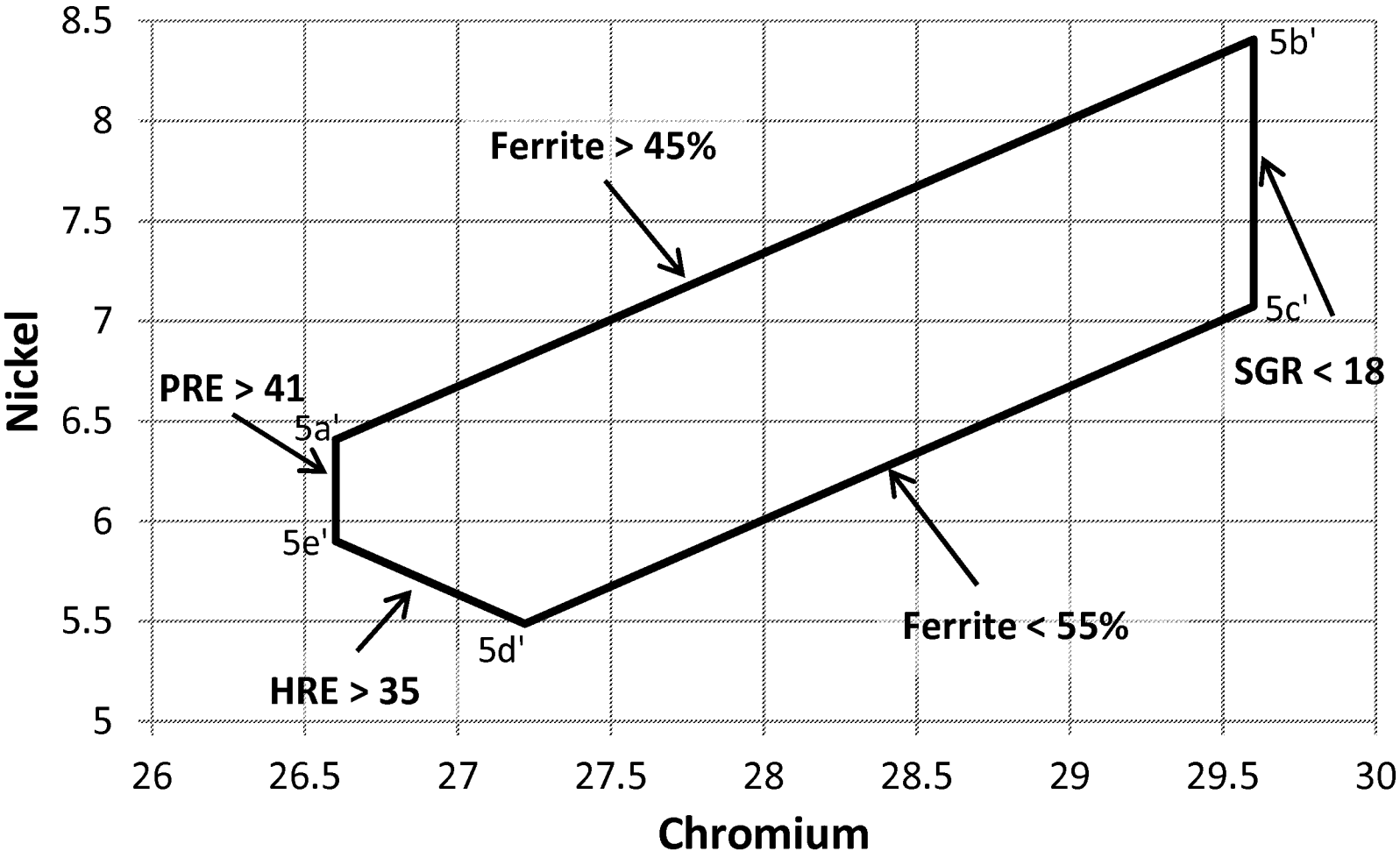
FIG. 4 illustrates a compositional window of chromium and nickel (1.2% Mn, 2.1% Cu, 2.0% Mo and 0.3% N) in the duplex stainless steels of the invention.
Figure 5:
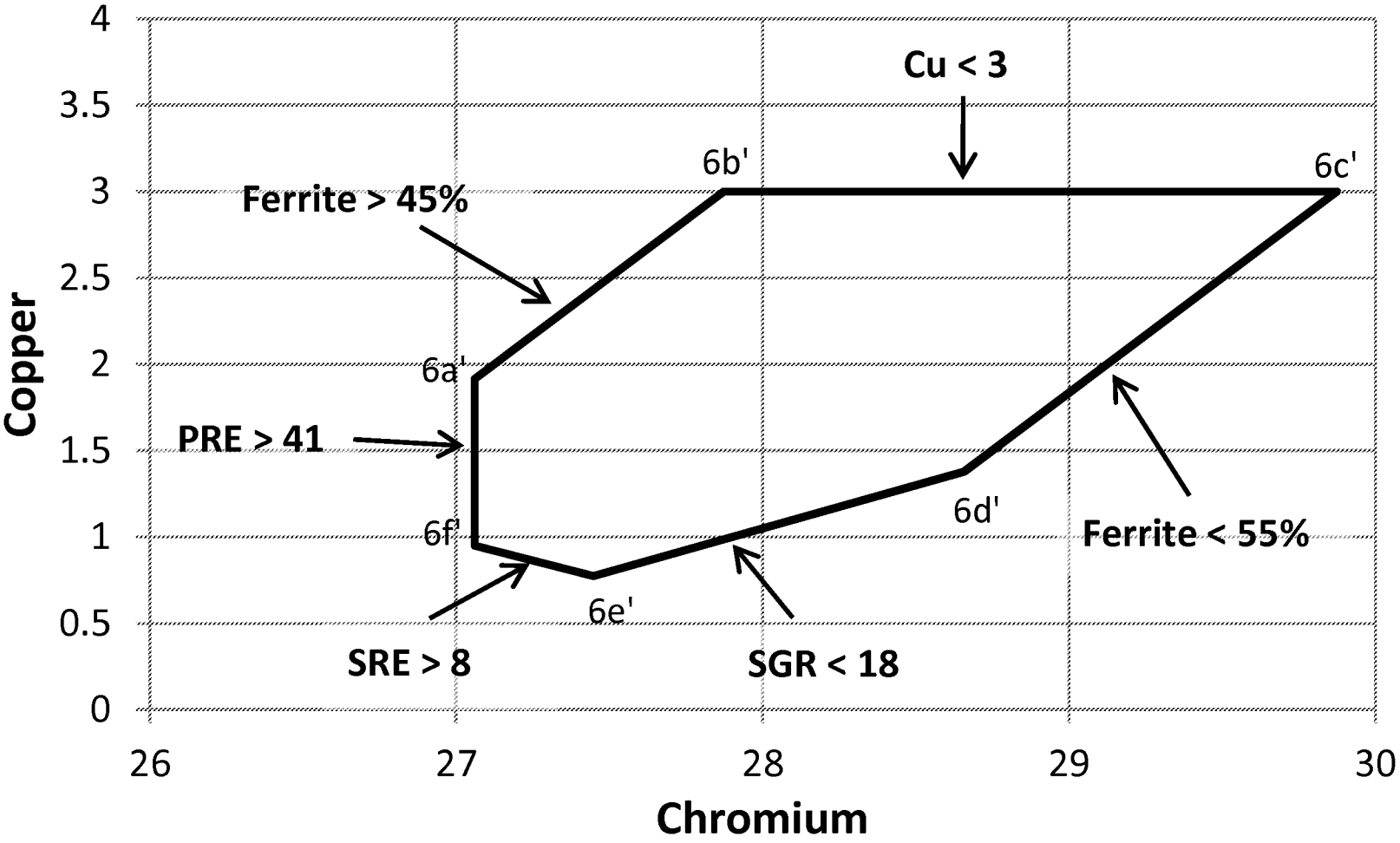
FIG. 5 illustrates a compositional window of chromium and copper (1% Mn, 6.5% Ni, 1.8% Mo and 0.3% N) in the duplex stainless steels of the invention.
Figure 6:
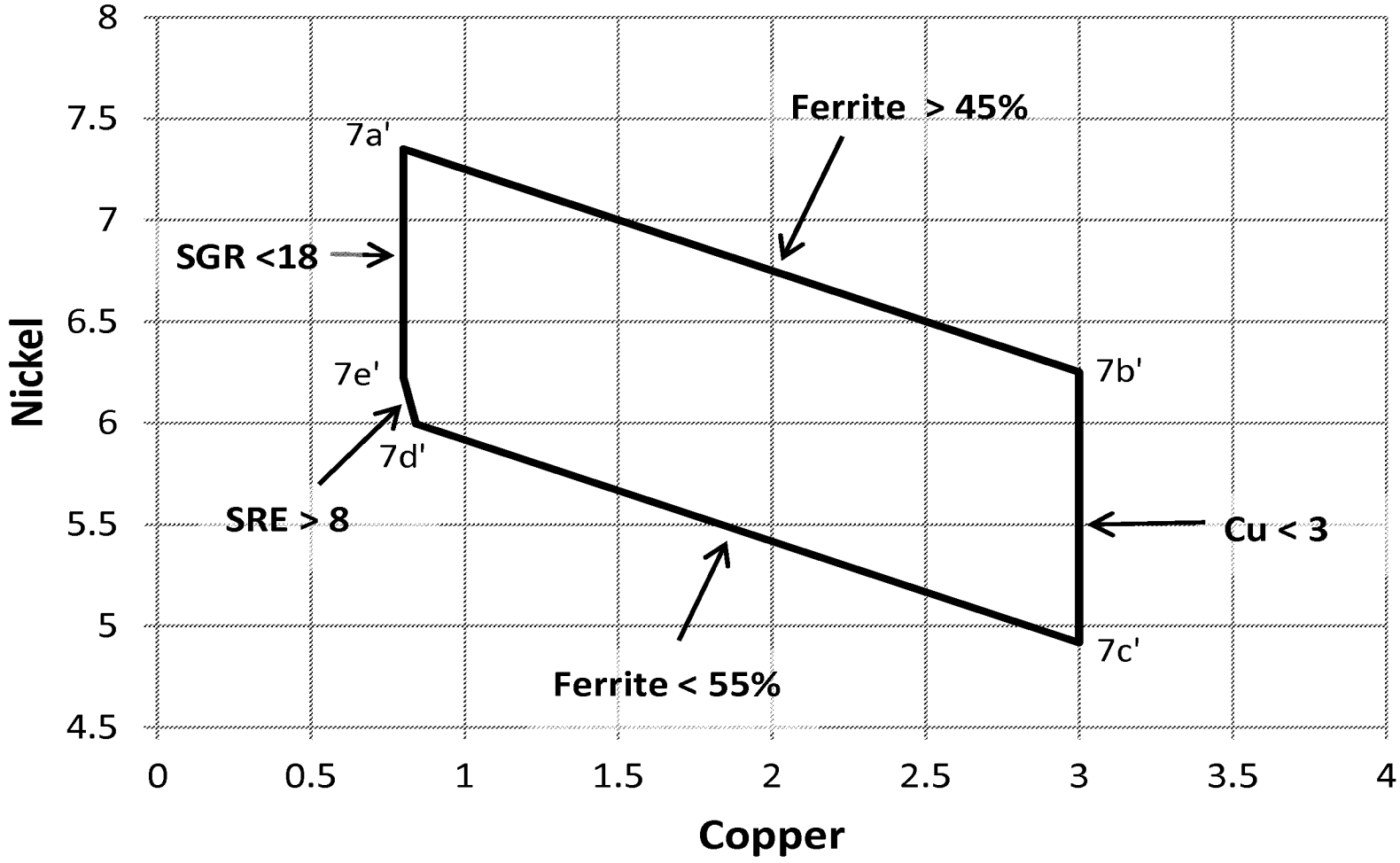
FIG. 6 illustrates a compositional window of nickel and copper (1% Mn, 27.5% Cr, 1.8% Mo and 0.3% N) in the duplex stainless steels of the invention.

Based on the results in terms of requirements for ferrite content, PRE, HRE SRE and SGR illustrations of compositional windows are shown in FIG. 4, FIG. 5 and FIG. 6. In these Figures the optimal compositional windows are defined for a section of the multi-dimensional space which defines the optimum alloy composition.

The duplex ferritic austenitic stainless steel according to the invention, with a composition of 1.2% Mn, 2.1% Cu, 2.0% Mo and 0.3% N, is illustrated by the chemical composition window of Cr and Ni, i.e. the dependence between the contents of Cr and Ni in weight %, which lies within the frame of the area 5a', 5b', 5c', 5d' and 5e' in FIG. 4, and is defined with the following labelled positions of the coordinates in weight % in the Table 5.

TABLE 5

| Position | Cr % | Ni |
|---|---|---|
| 5a' | 26.60 | 6.41 |
| 5b' | 29.60 | 8.41 |
| 5c' | 29.60 | 7.07 |
| 5d' | 27.22 | 5.49 |
| 5e' | 26.60 | 5.90 |

The labelled positions in the Table 5 for the duplex stainless steel of the invention are determined with the desired values for ferrite content in the microstructure, PRE, SRE, HRE and SGR as shown in FIG. 4.

The duplex ferritic austenitic stainless steel according to the invention, with a composition of 1% Mn, 6.5% Ni, 1.8% Mo and 0.3% N, is illustrated by the chemical composition window of Cr and Cu in weight %, i.e. the dependence between the contents of Cr and Cu, which lies within the frame of the area 6a', 6b', 6c', 6d', 6e' and 6f' in FIG. 5, and is defined with the following labelled positions of the coordination in weight % in the Table 6.

TABLE 6

| Position | Cr % | Cu % |
|---|---|---|
| 6a' | 27.06 | 1.92 |
| 6b' | 27.87 | 3.00 |
| 6c' | 29.87 | 3.00 |
| 6d' | 28.66 | 1.38 |
| 6e' | 27.45 | 0.77 |
| 6f' | 27.06 | 0.95 |

The labelled positions in the Table 6 for the duplex stainless steel of the invention are determined with the desired values of ferrite content in the microstructure, PRE, SRE, SGR and the Cu content as shown in FIG. 5.

The duplex ferritic austenitic stainless steel according to the invention, with a composition of 1% Mn, 27.5% Cr, 1.8% Mo and 0.3% N, is illustrated by the chemical composition window of Ni and Cu, i.e. the dependence between the contents Ni and Cu in weight %, which lies within the frame of the area 7a', 7b', 7c', 7d' and 7e' in FIG. 6, is defined with the following labelled positions of the coordination in weight % in the Table 7.

TABLE 7

| Position | Cu % | Ni % |
|---|---|---|
| 7a' | 0.80 | 7.35 |
| 7b' | 3.00 | 6.25 |
| 7c' | 3.00 | 4.92 |

TABLE 7-continued

| Position | Cu % | Ni % |
|---|---|---|
| 7d' | 0.84 | 6.00 |
| 7e' | 0.80 | 6.23 |

The labelled positions in the Table 7 for the duplex stainless steel of the invention are determined with the desired values of ferrite content in the microstructure, SRE, SGR and the Cu content as shown in FIG. 6.

Eight of the tested alloys (27-34) have chemical compositions that are inside the invention and the sigma equivalent (SGR), the HRE value and the content of the ferrite phase (volume %) are enlisted in Table 8.

TABLE 8

| Steel | HRE | SGR | SRE | PRE | Ferrite vol % |
|---|---|---|---|---|---|
| 27 | 36 | 15 | 9 | 42 | 49 |
| 28 | 37 | 14 | 10 | 43 | 48 |
| 29 | 36 | 17 | 11 | 41 | 48 |
| 30 | 37 | 18 | 10 | 42 | 57 |
| 31 | 37 | 14 | 11 | 42 | 50 |
| 32 | 36 | 17 | 8 | 40 | 48 |
| 33 | 38 | 19 | 9 | 41 | 56 |
| 34 | 37 | 17 | 10 | 41 | 48 |

The sigma equivalent (SGR) according to the formula (4) in the alloys 27-34 is below 19.

This condition means that the formation of the sigma phase in the microstructure of the duplex stainless steel according to the invention is essentially prevented.

The results shown in Table 8 also indicate that the corrosion rate in all the alloys 27-34 is favorable for the use in urea manufacturing conditions, because the Huey equivalent (HRE Value) according to the formula (1) is in the range of 35-39.5. This range in the Huey test corresponds to a corrosion rate of below 0.14 mm/year, as indicated in the results in the Table 2 and in FIG. 1.

The results in the Table 8 and in FIG. 1 also indicate that the corrosion rate in all the alloys 27-34 is favorable for use in the manufacture, transportation and use of sulphuric acid, because the sulphuric acid resistance equivalent (SRE) according to the formula (3) is above 8.

The results also show that the alloys 27-34 all have high resistance towards localized corrosion as PRE according to the formula (2) are above 40.

An important property of duplex stainless steels of the invention is the ease of the manufacture of these steels. In highly alloyed duplex stainless steels the hot workability and sensitivity to precipitation of intermetallic phases during hot working will be key elements to a successful high volume production of such grade. The properties of the precipitated phases will not be the limiting factor during the actual hot working but during the following cold operations involving such simple tasks as lifting and transporting and more elaborate operations such as levelling of plates and uncoiling coils etc., a duplex steel with excessive amounts of sigma phase will be as brittle as glass and cannot be handled in a normal steel mill operation.

The hot workability issues have in the present invention been addressed by controlling the key minor elements such as boron (B), calcium (Ca) and cerium (Ce) sulphur (S) and aluminium (Al). The sensibility to intermetallic phase precipitation is controlled by the major alloying elements Cr, Ni, Mo, Mn, Si, Cu and optionally W and Co as described in the section above regarding sigma equivalent in combination with hot rolling parameters.

The duplex ferritic austenitic steel of the invention can be produced as castings, ingots, slabs, blooms, billets and flat products such as plates, sheets, strips, coils, and long products such as bars, rods, wires, profiles and shapes, seamless and welded tubes and/or pipes. Further, additional products such as metallic powder, formed shapes and profiles can be produced.

The invention claimed is:

1. A duplex ferritic austenitic stainless steel for use in the chemical industry for nitric acid environments wherein good uniform corrosion resistance and high strength are required, wherein the microstructure of the stainless steel has 35-65 volume % of ferrite, the balance being austenite, and the chemical composition contains less than 0.03 weight % carbon, less than 1 weight % silicon, less than 3 weight % manganese, 26-29.5 weight % chromium, 5-8.5 weight % nickel, 1-3 weight % molybdenum, 0.25-0.35 weight % nitrogen, 1-3 weight % copper, up to 1 weight % tungsten, the rest being iron and inevitable impurities occurring in stainless steels, and wherein the sigma equivalent SGR ($Cr+2\times Mo-40\times N+0.5\times Mn-2\times Cu$) is less than 18, and the pitting resistance equivalent value PRE ($Cr+3.3\times Mo+30\times N—Mn$) is at the range of more than 41.

2. The duplex ferritic austenitic stainless steel according to the claim 1, wherein the Huey equivalent HRE ($Cr+1.5\times Ni-1.4\times Mn+0.6\times Mo+0.1\times N$) is in the range of 35-39.5.

3. The duplex ferritic austenitic stainless steel according to claim 2, wherein the sulphuric acid corrosion resistance SRE ($Cr+0.4\times Ni-1.1\times Mn+0.75\times Mo+2.2\times Cu+24\times N-0.3\times T$) is above 8 at the boiling temperature of sulphuric acid, above 11 at the temperature 95° C. and above 20 at the temperature 65° C.

4. The duplex ferritic austenitic stainless steel according to claim 2, wherein the chromium content is 26.5-29 weight %.

5. The duplex ferritic austenitic stainless steel according to claim 1, wherein the sulphuric acid corrosion resistance SRE ($Cr+0.4\times Ni-1\times Mn+0.75\times Mo+2.2\times Cu+24\times N-0.3\times T$) is above 8 at the boiling temperature of sulphuric acid, above 11 at the temperature 95° C. and above 20 at the temperature 65° C.

6. The duplex ferritic austenitic stainless steel according to claim 5, wherein the chromium content is 26.5-29 weight %.

7. The duplex ferritic austenitic stainless steel according to claim 1, wherein the chromium content is 26.5-29 weight %.

8. The duplex ferritic austenitic stainless steel according to claim 1, wherein the nickel content is 5.5-7.5 weight %.

9. The duplex ferritic austenitic stainless steel according to claim 1, wherein the manganese content is 0.5-1.5 weight %.

10. The duplex ferritic austenitic stainless steel according to claim 1, wherein the copper content is 1.3-2.5 weight %.

11. The duplex ferritic austenitic stainless steel according to claim 1, wherein the molybdenum content is 1.5-2.5 weight %.

12. The duplex ferritic austenitic stainless steel according to claim 1, wherein nitrogen content is 0.25-0.33 weight %.

13. The duplex ferritic austenitic stainless steel according to claim 1, wherein silicon content is less than 0.6 weight %.

14. The duplex ferritic austenitic stainless steel according to claim 1, wherein the stainless steel optionally contains one or more added elements: less than 0.04 weight % Al, less than 0.003 weight % B, less than 0.003 weight % Ca, less than 0.1 weight % Ce, up to 1 weight % Co, up to 0.1 weight % Nb, up to 0.1 weight % Ti, up to 0.2 weight % V.

15. The duplex ferritic austenitic stainless steel according to claim 1, wherein the stainless steel contains as inevitable impurities less than 0.010 weight % S, and less than 0.040 weight % P so that the sum (S+P) is less than 0.04 weight %, and the total oxygen content is below 100 ppm unless in a case of metal powder where total oxygen content is up to 250 ppm.

16. The duplex ferritic austenitic stainless steel according to claim 1, wherein the steel is produced in a form selected from the group consisting of castings, ingots, slabs, blooms, billets, plates, sheets, strips, coils, bars, rods, wires, profiles and shapes, seamless tubes welded tubes, seamless pipes, welded pipes, metallic powder, formed shapes and formed profiles.

17. The duplex ferritic austenitic stainless steel according to claim 1, wherein the microstructure of the stainless steel has 45-55 volume % of ferrite.

18. The duplex ferritic austenitic stainless steel according to claim 1, wherein the chromium content is 27-28.5 weight %.

19. The duplex ferritic austenitic stainless steel according to claim 1, wherein the nickel content is 5.8-7.5 weight %.

20. The duplex ferritic austenitic stainless steel according to claim 1, wherein the stainless steel contains as inevitable impurities less than 0.005 weight % S, less than 0.040 weight % P so that the sum (S+P) is less than 0.04 weight %, and the total oxygen content is below 50 ppm.

* * * * *